United States Patent [19]

Wengert et al.

[11] Patent Number: 4,622,272

[45] Date of Patent: Nov. 11, 1986

[54] LUMINESCENT SCREEN FOR PICTURE DISPLAY APPARATUS AND METHOD FOR MANUFACTURING SUCH DEVICE

[75] Inventors: Rolf Wengert; Pietro Cicchi, both of Munich, Fed. Rep. of Germany

[73] Assignee: Siemens Aktiengesellschaft, Berlin and Munich, Fed. Rep. of Germany

[21] Appl. No.: 738,487

[22] Filed: May 28, 1985

[30] Foreign Application Priority Data

Jul. 31, 1984 [DE] Fed. Rep. of Germany ..... 3428244

[51] Int. Cl.[4] ..... H01J 31/12; H01J 29/32

[52] U.S. Cl. ..... 428/690; 428/691; 428/917; 313/503; 250/486.1

[58] Field of Search ..... 428/690, 691, 917; 313/503, 506, 509; 250/486.1, 488.1

[56] References Cited

U.S. PATENT DOCUMENTS

| | | | |
|---|---|---|---|
| 3,986,073 | 10/1976 | Duinker et al. | 313/477 R |
| 4,020,191 | 4/1977 | Nagashiro et al. | 427/12 |
| 4,243,695 | 1/1981 | Wengert et al. | 427/14.1 |
| 4,243,735 | 1/1981 | Kobale et al. | 430/25 |
| 4,325,002 | 4/1982 | Kobale et al. | 313/485 |

FOREIGN PATENT DOCUMENTS

| | | |
|---|---|---|
| 2806436 | 8/1979 | Fed. Rep. of Germany . |
| 2804127 | 8/1979 | Fed. Rep. of Germany . |
| 2540132 | 11/1979 | Fed. Rep. of Germany . |
| 2855090 | 1/1980 | Fed. Rep. of Germany . |
| 2855142 | 6/1980 | Fed. Rep. of Germany . |

*Primary Examiner*—John E. Kittle
*Assistant Examiner*—Patrick J. Ryan
*Attorney, Agent, or Firm*—Hill, Van Santen, Steadman & Simpson

[57] ABSTRACT

A luminescent screen for a picture display apparatus comprising a plate glass screen 1 and a luminophore layer 6 formed on the glass plate in depressions 4 that are surrounded by a black pigmented contrasted border layer 5. The luminescent screen has an optimum color purity and in particular off-color combinations on the surface of the layer of the respective color should be avoided and is undesirable. For this purpose, the invention provides that the luminous colors of the luminophore layer 6 comprising the luminous colors red (R), green (G) and blue (B) are applied to the screen glass plate 1 in a raster of line-like systematic arrangements by using a silk screening process. Luminescent screen according to the invention is employed as a flat plasma picture screen.

3 Claims, 2 Drawing Figures

LUMINESCENT SCREEN FOR PICTURE DISPLAY APPARATUS AND METHOD FOR MANUFACTURING SUCH DEVICE

BACKGROUND OF THE INVENTION

1. Field of the Invention

The invention relates in general to luminescent screens for picture display tubes and to a method for making such apparatus.

2. Description of the Prior Art

Multi-color luminescent screens are usually manufactured in a known fashion using a "slurry" photo technique method. Other proposals have also been advanced for applications for making flat picture display devices. German OS No. 28 04 127 which corresponds to U.S. Pat. No. 4,243,695 discloses a method of spraying which can only be utilized up to certain resolution limits with respect to the screen definition.

German OS No. 28 06 436 which corresponds to U.S. Pat. No. 4,243,735 and German OS No. 28 55 142 which corresponds to U.S. Pat. No. 4,325,002 disclose methods for the manufacture of conductive, mechanically stable luminescent screens particularly with black color spot borders which have worked satisfactorily and from which the present invention comprises an improvement.

German AS No. 25 40 132 which corresponds to U.S. Pat. No. 4,020,191 discloses a printing method which in addition to imprinting of luminophores additionally requires a photo technique for precise positioning.

Methods are known which are based on dusting or respectively brushing onto adhesive layers a luminescent powder wherein the adhesive layers have been selectively rendered "sticky" by exposure. See for example, British Pat. No. 2,111,233, German No. 29 34 929 which corresponds to U.S. Pat. No. 4,263,385.

Each of the above described methods and apparatus have disadvantages.

SUMMARY OF THE INVENTION

It is therefore an object of the present invention to provide a high resolution multi-color luminescent screen which meets the following conditions: The thickness of the luminophore layer should be as thin as possible assuming simultaneously high surface occupation density which gives high transparency. Extreme color purity should be obtained and in particular an off color combination at the surface of the layer of the respective color which is a site upon which the electron beam impinges should be avoided. Also, separation of the color regions by black pigmented regions should be utilized for enhancing the contrast as well as for sharp separation of the light exciting electron beams for the individual colors so as to obtain color purity in the electron beam operation.

The object of the present invention is achieved by forming a luminescent screen for a picture display apparatus wherein a screen glass plate and luminophore layer is applied thereto into depressions formed in the surface of the glass plate and wherein the luminophore layer regions are surrounded by a black pigmented contrast border between the color regions and wherein the luminophore layer 6 is formed of the luminous colors red, green and blue which are applied to the screen glass plate in a raster or line shaped systemmatic arrangement using a silk screening process.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
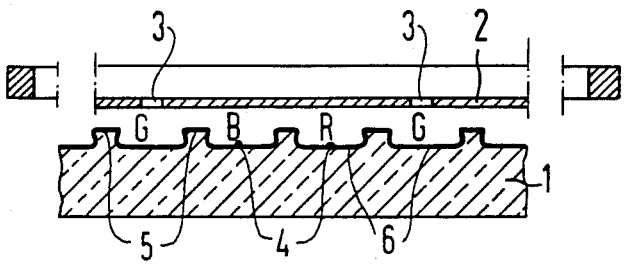
FIG. 1 is a sectional view illustrating the luminescent screen of the invention.

In the invention, when the luminous colors are applied such as the colors red, green and blue to the luminescent screen by silk screening additional photo technique processes are not required and the screen is made in a simple and inexpensive manner.

So as to enable successive occurring silk screening of the various colors without damaging the preceding prints by the following prints in the invention it is provided that the color regions are protected by mechanically stable elevated black borders. Although raised black borders may be known in the prior art, it is not obvious to apply luminophore regions with silk screening since silk screening normally functions only with direct contact with the surface. The silk screening in the present invention was enabled by modification of the printing technique with significantly smaller print areas on the screen (template) then on the substrate, high squeegee pressure and special flow properties of the luminophore paste.

As contrasted to known screening methods the invention has significant advantages which can only be achieved with the new silk screening process of the invention.

Specifically, for low energy cathode ray excitation of luminophores (greater than 10keV) but also conceivably for other applications a quality of the luminophore layer is required which assuming a very high surface occupation density with luminophore "bodies" of an optimally established size and light efficiency (0.1 m through 30 m grain), simultaneously has the lowest possible layer thickness for its type which gives highlight transparency. This is achieved with a method of the invention by setting the flow properties of the luminophore paste as well as the use of a precise dosing of the quantity per unit area when printing. For example, such a layer manufactured cannot be accomplished with prior art "slurry" photo techniques.

At the same time, in the invention, an extremely high color purity is required precisely at the surface of the applied luminophore layer and becomes more compelling with lower cathode ray excitation energy which produces lower penetration depth of electrons into the luminophore layer. Prior art methods wherein after application of a first color the other colors are layered on top of each other, exposed and partially removed in turn are therefore less suitable for producing the required pure color layer surface which is obtained with the invention. When a sharp separation of color spots is not assured by a given electron beam geometry or when due to adjustment in precisions of various display components, "safety zones" for the exciting electron beam are necessary in order to avoid off color or when an enhancement of the contrast is necessary then a separation of the color regions by black-pigmented regins (black border "black matrix") is required. Such requirements occur for the utilization of luminescent screens used for flat plasma picture screens and can be met by the proposed inventive silk screening process.

In contrast to the present invention German OS No. 28 06 436 which corresponds to U.S. Pat. No. 4,243,735 discloses a black border with good adhesion which is built up with the assistance of phototechniques, in the present invention, the screening concept is that the black border of the black pigmented glass solder paste or respectively of glass solder paste which turns black during sintering is applied in precise positions using silk screening.

An essential point of the present invention particularly for applications wherein the luminescent screen of the invention is used in display systems under the influence of high electrical field strengths, good adhesion to the substrate is demanded particularly for the black border as well as the color luminophores. In the invention, the embodiment best suited for this purpose comprises the two black border modifications with vapor deposition and etching structures which use the silk screening process disclosed herein.

The luminescent screen of the present invention is manufactured for example in the following manner: a layer is vapor deposited onto a glass plate (screen plate) of an arbitrary size and thickness which can be either planar or cylindrically curved preferably in a layer sequence of $Al_2O_3$—Ni—$Al_2O_3$—Ni in the range from one through twenty sequences of various thicknesses between 2 nm and 100 nm and wherein the final Ni layer is between 20 nm and 1000 nm.

This layer is then covered with photoresist and exposed with a defined structure of the black border including defined registration marks and is developed in a conventional manner. The vapor deposited structure is then etched away where the luminophores are to be provided in the windows of the photoresist.

Before applying the luminophores, the glass is etched by etching the coating surface such that depressions between 1 um and 50 μm result. At the same time, the etching is accomplished to make the surface as smooth as possible with an etching solution having the following composition:

$H_2O$: 20 vol. % through 90 vol. %
conc. $H_2SO_4$: 5 vol. % through 40 vol. %
conc. HF: 5 vol. % through 30 vol. %
saturated ammonium
fluoride solu.: 0 vol. % through 12 vol. %.

Good dereflection of the side coated with phosphorous after the etching as well as the increased adhesion of the luminophore which is subsequently to be applied to the roughened surface and the mechanical protection which results since the luminophores are mounted in the depression provide a number of advantages. The depression is preferably set such that they approximately corresponds to the layer thickness of the luminophore which will be later applied so that as smooth as possible a surface (field strength load) is present as a substrate for the illuminization of the luminescent screen which will be later applied.

The luminophore structure which preferably is of three colors red, green and blue arranged in a very fine matrix (greater than 0.3 mm steps) preferably in line arrangement is generated by successively printing of the individual colors in the spaces at the positions provided therefore within the black border. The luminophore material must maintain a precise relationship to the desired layer thickness to the area of the printing template and to the flow property of the luminophore paste. An important component of the luminophore paste is an adhesion promoter which remains in the temperate condition after the binder components have been "expelled". A $SiO_2$ coating fluid is, for example, useable. A number of other binders are also suitable for use as long as they neither chemically damage the luminophore nor leave disturbing "residues" after the tempering of the layers and it should be realized that the luminophore maximum temperature is in the range of 380° C. to 500° C. Binders such as an acrylate or nitrocellulose base are preferably employed. A preferred composition for example is:

Luminophore: 40 vol. % to 90 vol. % (e.g. 71 vol. %)
Adhesion promoter: 0.1 vol. % to 5 vol. % (e.g. 0.4 vol. %)
Binder: 0 vol. % to 20 vol. % (e.g. 7 vol. %)
Thinner: 10 vol. % to 50 vol. % (e.g. 21.6 vol. % for example, terpineol)

The luminophore may be formed of: for example green luminophore ZnS:Cu,Al,Au

| | | |
|---|---|---|
| green | luminophore | $Y_2O_2S$:Tb |
| red | " | $Y_2O_3$:Eu |
| red | " | $Y_2O_3$:Eu |
| blue | " | ZnS:Ag |

The thickness of the luminophore layers may fall in the range of 1 μm and 70 μm and preferably would be about 20 μm using the above examples of luminophores. It is therefore essential that the printing area on the template screen comprise only 20 to 70% preferably 40% of the area openings in comparison to the area to be printed. The silk screen suitable for the printing fall in the range between 165 mesh and 600 mesh and are preferably 400 mesh and depends on the demanded resolution of the raster.

After the layer production has been produced it is assured by tempering that all of the binder components are volatized whereby significant advantage of the proposed silk screening method is to be able to use a very small binder constituent so as to thus achieve a high surface density of the phosphorous coating.

The luminescent screen can however also be manufactured in the following manner: a glass solder layer in the desired structure of the black border is printed on a glass plate of arbitrary size and thickness which may be planar or cylindrically curved. For purposes of dereflecting the inside of the picture screen on which the phosphor layer is applied it is recommended to produce a relatively smooth dereflecting layer with the glass etch utilized in the first example after the glass has been previously very uniformly dulled mechanically by lapping with fine granulation silicon carbide preferably 500–1000 size. This method has the advantage that a dereflecting of the glass side coated with phosphor is accomplished inconjunction with an enhancement of the adhesion of the applied layers.

The thickness of the black border desired after sintering of the glass solder imprint is in the range between two 2 μm and 60 μm. So as to achieve black pigmentation of the glass solder paste, a "black dye" additive may be used which assures the constancy of the thermal spread and in solidity of the glass solder application after sintering. A number of types of materials are fundamentally suitable as binders when a complete burnout is assured at the temperature required or, respectively, maximally allowed for a specific type of glass solder. An expedient glass solder mixture for this purpose is:

| | |
|---|---|
| Glass solder, preferably crystallizingly meltable at 430° C. | 50 Wt. % to 95 wt. % (for example, 65 wt. %) |
| "Black dye" (for example, mixture of chrome oxide, cobalt oxide, nickel oxide, lead oxide) | 0 wt. % to 40 wt. % (for example, 15 wt. %) |
| Binder on acrylate basis | 0.1 wt. % to 25 wt. % (for example, 1.2 wt. %) |
| Thinner (for example, terpineol) | 0.5 wt. % to 40 wt. % (for example, 18.8 wt. %) |

Black colorization can also be produced or encouraged without black dye by means of reducing tempring.

After the black border structure has been produced in the above manner, the remaining steps of the process are formed as in the first exemplary embodiment discussed above.

FIG. 1 illustrates the glass screen 1 which is formed with depressions 4 as described above. The depressions 4 are etched to a depth of about 10 μm through 20 μm into the luminescent screen glass 1 as described above using the photoresist or the glass solder method. The luminophore layer 6 with the colors red (R), green (G), and blue (B) is applied using a silk screening process through the mask or film 2 which is provided with screening apertures 3. In the embodiment illustrated in FIG. 1, the black border 5 is formed using a phototechnique (thin film).

Figure 2:
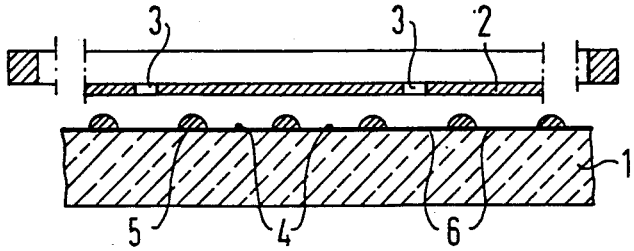
FIG. 2 is a further embodiment of the luminescent screen of the invention illustrated in sectional form.

FIG. 2 illustrates a second embodiment wherein the black border is applied with silk screen as black glass solder through the screening apertures 3 of the screen 2 and the black border 5 is applied to the luminescent screen glass 1 so that depressions 4 are formed between the black border regions 5 and the depressions have depths of about 20 μm depending on the thickness of the glass solder. The luminophore layers 6 which are the luminescent screen colors are then formed in the depressions 4 with colors such as red, green and blue.

Although the invention has been described with respect to preferred embodiments, it is not to be so limited as changes and modifications can be made which are within the full intended scope of the invention as defined by the appended claims.

We claim as our invention:

1. A luminescent screen for a picture display apparatus comprising, a screen glass plate formed with a plurality of depressions aligned in a raster shape on one planar surface, a luminophore layer applied to said glass plate in said depressions, a black-pigmented contrast border layer on said glass plate around said depressions, characterized in that the luminous colors of said luminophore layer (6) are preferably the luminous colors red (R), green (G) and blue (B) and are applied to said screen glass plate (1) in a raster or line-shaped arrangement by a silk-screening process.

2. A luminescent screen according to claim 1, characterized in that said contrast border layer (5) of black-dyed glass solder paste or of glass solder paste which turns black when sintered is applied to the screen glass plate (1) in exact positions by a silk-screening process.

3. A luminescent screen according to claim 1 or 2, characterized in that the thickness of the luminophore layer (6) is in the range between 1 μm and 70 μm.

* * * * *